United States Patent [19]

Morwood

[11] Patent Number: 4,696,064

[45] Date of Patent: Sep. 29, 1987

[54] NECKTIE AND METHOD OF TYING

[76] Inventor: Robert A. Morwood, 722 N. Jefferson, Mason City, Iowa 50401

[21] Appl. No.: 40,136

[22] Filed: Apr. 20, 1987

[51] Int. Cl.[4] ..... A42B 5/00

[52] U.S. Cl. ..... 2/144; 2/146; 289/1.5

[58] Field of Search ..... 2/144, 146, 155; 289/1.5

[56] References Cited

U.S. PATENT DOCUMENTS

| | | | |
|---|---|---|---|
| 1,208,167 | 12/1916 | Knotts | 2/146 |
| 1,273,263 | 7/1918 | Mills | 2/146 |
| 2,243,979 | 3/1944 | Kaplan | 2/146 |
| 2,343,979 | 3/1944 | Kaplan | 2/146 |
| 2,504,843 | 4/1950 | Kaplan | 2/146 |
| 2,545,971 | 3/1951 | Rinehart | 2/146 |
| 3,025,528 | 3/1962 | Minter | 2/144 |
| 4,613,992 | 9/1986 | Dabbieri | 2/144 |

*Primary Examiner*—Louis K. Rimrodt

*Attorney, Agent, or Firm*—Warren F. B. Lindsley

[57] ABSTRACT

A necktie and method of tying having front and rear sections, each section having front and rear faces, the front face of the front section and the rear face of the rear section being arranged to face in the same direction when the tie is lying flat and involves a method of tying this type of tie in a simplistic knot that encircles the neckband on both its left side and its right side with one cross-over to form the face of the completed knot.

4 Claims, 7 Drawing Figures

NECKTIE AND METHOD OF TYING

BACKGROUND OF THE INVENTION

This invention relates to apparel and more particularly, to a novel necktie in which the face and tail portions of the tie are sewn together or attached by other means, with the tail portion reversed so as to have its back surface forming a continuous surface with the front surface of the tie. Further, improvements facilitate the formation of an innovative knot in such a way that after completion of the knot, the free ends of the tie will substantially register and the knot of the tie will be formed by a minimum number of plies of fabric.

Ordinarily, in the manufacture of four-in-hand folded neckwear, the material forming the large end and the small end are cut separately and attached to each other by a diagonal seam in the neckband portion. This results in making the tie thicker at that particular point and acts as an impediment to the free movement of the tie around the neckband between the plies of a two-fold collar.

DESCRIPTION OF THE PRIOR ART

U.S. Pat. No. 1,273,263 discloses a four-in-hand tie having ends of equal proportion being reversed to one another and having an extended overlapping neckband so that different patterns or colors at opposite ends would have matching colors or patterns on exposed neckbands when used with standing collars. The "tail" of this tie would always be reversed when tied with the four-in-hand knot when encircling the neck.

U.S. Pat. No. 2,343,979 discloses a four-in-hand necktie having a wide end and a narrow end and having a neckband connecting the two. An index element is utilized on the rear ply of the wide end located at a distance from the free end thereof substantially equal to the aggregate length of the material used in forming the four-in-hand knot.

U.S. Pat. No. 2,504,843 discloses a four-in-hand necktie having an index J which is placed at the rear buttonhole of a collar of the user. A second index I is located on the reverse side of end portion A.

U.S. Pat. No. 2,545,971 discloses a two-piece tie. A rear section 36 having a rear face 38 is joined at a stitch line 70 to a front face 31 of a front section 30. A short bar or band is utilized at the front of the collar band of the shirt over which the tie passes where it is tied in substantially the same manner as the usual four-in-hand tie is tied. With this disclosure, a tie of substantially a lesser length than a long tie of normal construction may be used since the portion normally extending around the neck of the wearer is eliminated. It is the draping of the tie over the collar bar that effects the same result as passing a conventional length four-in-hand tie around the neck.

U.S. Pat. No. 1,208,167 discloses a tie which may be worn in a manner to expose any one of four different patterns, colors or materials of which it is composed so as to produce the same effect as could be obtained by the employment of as many different ties.

SUMMARY OF THE INVENTION

In accordance with the invention claimed, a new and improved necktie and method of tying are disclosed employing a simplistic knot that encircles the neckband on both its left side and its right side with only one cross-over to form the face of the completed knot. This novel method not only produces a perfectly balanced knot, but a knot that has far less bulk than the conventional windsor knot. The windsor knot requires that the face of the tie be passed over and returned under the tail of the tie before the first encirclement of the neckband can be effected. This results in added thickness to the completed knot.

It is, therefore, one object of this invention to provide a new and improved tie that can be tied each time without further adjustment of the knot relative to the collar of the shirt of a user and with assurance that when the knot is complete, the ends of the tie will register.

Another object of this invention is to provide a means for stitching the two portions of the tie together at a point which serves as an index to be positioned at the nape of the neck when tying the tie so as to result in registered ends of the knotted tie.

A further object of this invention is to provide a new and improved method of tying a necktie.

A still further object of this invention is to provide a tie of the character described which can be tied much more easily than a conventional long tie.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figures 1, 2, 3, 4A, 4B, 4C, 4D:
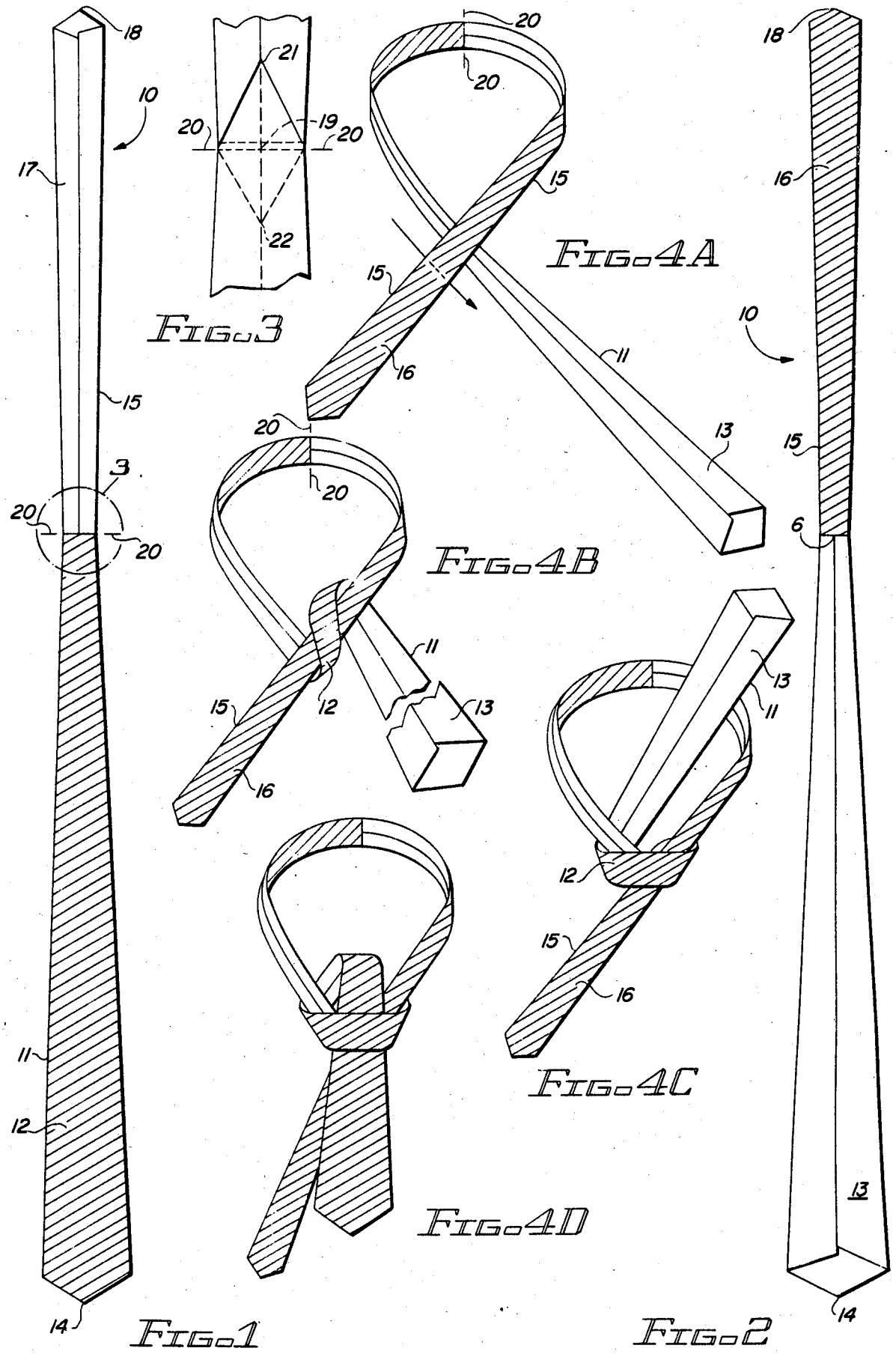
FIG. 1 is a plan view of a tie showing one side thereof with the front and back sections at opposite ends of the same surface and embodying the invention.
FIG. 2 is a plan view of FIG. 1 showing the opposite surface of the tie.
FIG. 3 is an enlargement of the circled area 3 of FIG. 1.
FIGS. 4A–4D are perspective views of the sequence of steps in the formation of the knot disclosed.

Referring more particularly to the drawing by characters of reference, FIG. 1–3 disclose a tie 10 having a front section 11, a front face 12, a rear face 13, a pointed end 14, and a rear section 15 of somewhat shorter length and width than the front section and similarly has a front face 16 and a rear face 17. The rear section also may have a pointed end 18. Each section is wider at its outer end and inclines inwardly to a point 19 which may be considered as the general location of the transverse median line 20-20 of the necktie where one section merges into the other.

It will be noted that when the tie is lying flat, front face 12 of front section 11 and rear face 17 of rear section 15 are in the same direction so that when in folded position of FIG. 4D, both front faces are directed forwardly when the tie is tied in the manner hereinafter described.

FIG. 3 illustrates that the junction of front section 11 and rear section 15 may be formed by a tapered end 21 of the front section overlapping a portion of front face 16 of the rear section and point 22 of the rear section overlapping a part of rear face 13 of front section 11. This type of junction eliminates the prior art structures embodying the numerous plies of material at and along the neckband of the tie.

The formation of the innovative knot is herewith disclosed, assuming the tie has been looped, as shown in FIG. 4A, around the collar of the user with the median line 20-20 being positioned at the center of the nape of the neck. The narrow section 15 of the tie, with front side 16 exposed, is then passed over the reverse side 13 of the wide section 11 of the tie. The wide end 13 of the tie is then looped up and over that part of the narrow end 15, encircling the neck, as shown in FIG. 4B. The wide end 11 is then crossed to the opposite side to form the face of the knot. The wide end 11 is then passed under and up behind the neckband on the opposite side, thereby forming the loop of the knot, as shown in FIG. 4C. The wide end 11 of the tie is then passed down and through the formed loop to complete a perfectly balanced knot, as shown in FIG. 4D.

The disclosed knot encircles the neckband on both left and right sides of the rear section of the tie with one cross-over to form the face of the completed knot. This results in not only a perfectly balanced knot, but a knot that has far less bulk than the conventional windsor or four-in-hand knots.

The windsor knot requires that the "face" of the tie be passed over and returned under the tail of the tie before the first encirclement of the neckband can be effected. This added thickness of the completed knot creates bulk and minor imbalance to the completed knot.

The disclosed simplistic knot is basically a modified windsor knot, but the unique construction of the disclosed tie enables the user to eliminate the above mentioned cross-over and return steps before the first encirclement of the neckband is effected.

By using the disclosed knot, ties can now be constructed so as to be tailored to the individual's particular physique, the pertinent factors being the girth of the neck and the distance from the collar of the user to his waistline.

The construction of the disclosed tie can be made in as many varied lengths as the manufacturer deems necessary. The rule of thumb for the construction of ties of different lengths is basically that the front section is 3/5 of the total length of the tie and the rear section is 2/5 of the total length of the tie. If the junction point of the front and rear sections is placed at the center of the nape of the neck of the user, a perfectly tied balanced knot will result with the points of the front and rear sections in proper register.

It should be known that although the front and rear sections of the tie may be sewn, a suitable pivot joint may be used so that the front faces of the front and rear sections of the tie may be aligned or disaligned, as desired. Thus, this tie design may be used for a four-in-hand knot or the knot disclosed herein depending on the position of the faces of the front and rear sections of the tie.

Although but one embodiment of this invention has been illustrated and described, it will be apparent to those skilled in the art that various changes and modifications may be made therein without departing from the spirit of the invention or from the scope of the appended claims.

What is claimed is:

1. A necktie having front and rear sections with each section having front and rear faces, the front face of the front section and the rear face of the rear section being arranged to face in the same direction when the tie is lying flat, said front section being substantially 3/5 of the total length of said tie and the rear section being substantially 2/5 of the total length of said tie, said front section and said rear section each comprising a tapered point at its widest end and secured together at their narrow ends by a fastening means, said fastening means being mounted on the narrow end of each of the front and rear sections and cooperating to secure these sections together and forming an index point for aiding in positioning of the tie at the nape of the collar of a user.

2. A necktie having front and rear sections with each section having front and rear faces, the front face of the front section and the rear face of the rear section being arranged to face in the same direction when the tie is lying flat, said front section being substantially 3/5 of the total length of said tie and the rear section being substantially 2/5 of the total length of said tie, said front section and said rear section each comprising a tapered point at its widest end and secured together at their narrow ends by a fastening means, said fastening means comprising a pointed tab on the narrow end of each of the front and rear sections which ends overlap and are secured together forming an index point for aiding in positioning of the tie at the nape of the collar of a user.

3. The necktie set forth in claim 2 wherein:

said tabs overlap each other and are secured to the narrow end of the other section of the tie.

4. A method of tying a knot for a necktie having front and rear sections with each section having front and rear faces, the front face of the front section and the rear face of the rear section being arranged to face in the same direction when the tie is lying flat, comprising the steps of:

looping the tie around the nape of the neck of a user with the rear face of the front section and the front face of the rear section exposed, holding its rear section taut with its front face exposed, crossing the front section over the tautly held rear section and into the top of the loop of the tie, moving the front section through the loop and out of the bottom of the loop thereby completing a 360 degree movement of the front section around the rear section, moving the front section over the front face of the rear section, into the loop from its bottom and through the loop and its top, and tucking the end of the front section back through the knot between the front of the rear section and the back of the front section and pulling the knot tight.

thereby exposing both front faces of the front section and the rear section of the tie.

* * * * *